US005118301A

United States Patent [19]

Bentivolio

[11] Patent Number: 5,118,301

[45] Date of Patent: Jun. 2, 1992

[54] ELECTRICAL CONNECTOR DEVICE

[76] Inventor: Valentino Bentivolio, 2850 South Hill Rd., Milford, Mich., 48381

[21] Appl. No.: 694,767

[22] Filed: May 2, 1991

[51] Int. Cl.[5] ..... H01R 29/00

[52] U.S. Cl. ..... 439/188; 200/51.09; 200/531; 200/536; 439/513; 439/628; 439/638

[58] Field of Search ..... 439/93, 188, 628, 655, 439/638, 513; 200/51.09, 51.10, 51.12, 531, 536, 510

[56] References Cited

U.S. PATENT DOCUMENTS 4,230,386 10/1980 Farnworth et al. ..... 439/188

*Primary Examiner*—Paula A. Bradley
*Attorney, Agent, or Firm*—Brooks & Kushman

[57] ABSTRACT

An electrical connector device has first and second male terminal sets adapted to couple with matched female connector devices. The electrical connector device has particular utility in coupling an auxiliary generator with female power take off receptacles to a conventional receptacle in a wiring circuit. The device includes a switch mechanism associated with each terminal set to avoid exposure of energized terminals. The switch mechanism preferably takes the form of a plunger which is reciprocable between a retracted position and an extended position. In moving the plunger between its retracted and extended positions the plunger "makes" and "brakes" contact respectively for its associated terminal set with internal conductors in the connector device. The electrical connector device is adapted for all types of electrical power connections, including conventional 110 volt and 220 volt circuit receptacles.

6 Claims, 2 Drawing Sheets

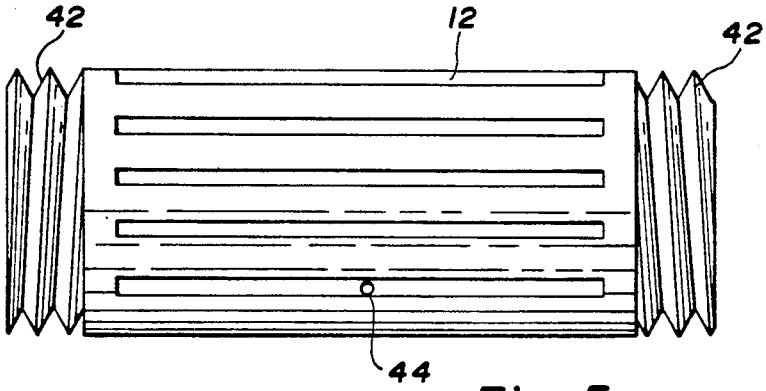
Fig. 5
Fig. 6
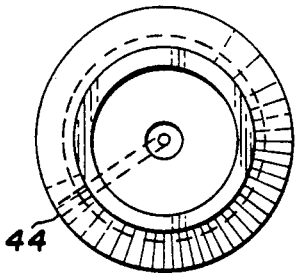
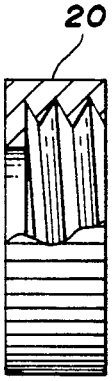
Fig. 7
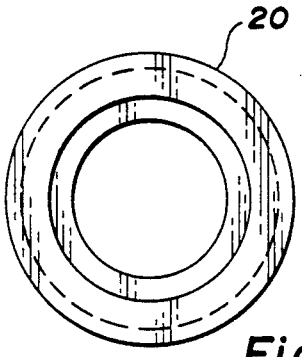
Fig. 8
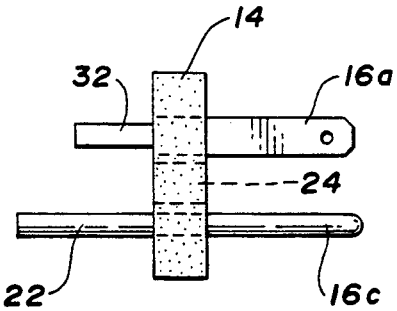
Fig. 9
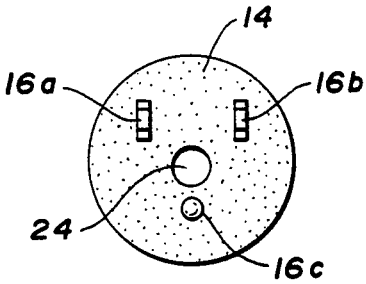
Fig. 10
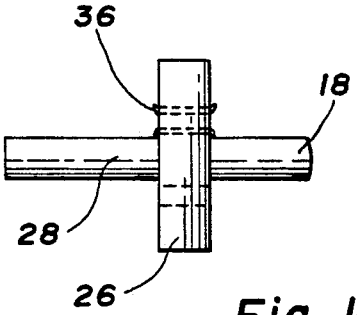
Fig. 11
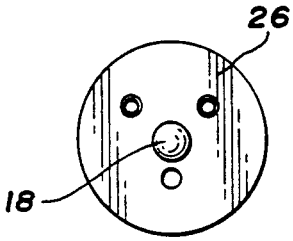
Fig. 12

ELECTRICAL CONNECTOR DEVICE

TECHNICAL FIELD

1. Field of the Invention

This invention relates to electrical connector devices for use in power transmission applications.

2. Background Art

A practical problem encountered in connecting a conventional auxiliary generator to a household circuit during a power outage is interfacing the generator power output to receptacles in the household wiring circuit. This task requires an extension cord with male terminals on each end to interconnect the generator output and the household receptacle.

In addition, the order in which the extension cord terminals are connected is important. The cord must be connected first to the household receptacle. If the cord is first connected to the generator output, the terminals at the opposite end will be energized and risk electrical shock or shorting of the circuit.

The present invention addresses these problems and concerns with a novel electrical connector device which provides a gender reversal to enable connection of a generator with a household receptacle without sensitivity to the order of connection.

SUMMARY OF THE INVENTION

The present invention is an electrical connector device for transmitting power between female connector devices, such as the power output of an auxiliary generator and a household receptacle.

The connector device comprises a body having first and second connector faces, preferably at opposed ends of the body. Each face has associated with it a male terminal set which includes a plurality of at least two terminals adapted to couple with a matched female connector device. Extending internally of the body between the connector faces are a like plurality of electrical conductors, e.g. copper rods. At least one of the conductors has a switchable connection with one of the terminals of each terminal set. The switching is accomplished with a mechanism actuated through coupling and decoupling of the terminal set with its mating female connector. The mechanism may be a spring-biased plunger which has a normally extended position with the terminal set decoupled from the female connector. However, upon coupling of the terminal set to the female connector the plunger is retracted and connection is made between the involved terminal and its respective internal conductor.

This type of electrical connector device is adapted for use in all similar types of electrical power transmission involving the interfacing of female connector devices, including conventional 110 volt and 220 volt household and industrial applications.

BRIEF DESCRIPTION OF THE DRAWINGS

FIG. 5 is a detail view of the body of the electrical connector device of FIG. 1;

FIG. 6 is an end vie of the body of the electrical connector device;

FIG. 7 is a side view of the threaded end cap of the electrical connector device;

FIG. 8 is an end view of the threaded end

FIG. 9 is a side view of one of the terminal set inserts used in the electrical connector device;

FIG. 10 is an end view of one of the terminal set inserts;

FIG. 11 is a side view of one of the reciprocable plungers used at each end of the electrical connector device;

FIG. 12 is an end view of the reciprocable plunger.

BEST MODE FOR CARRYING OUT THE INVENTION

Figure 1:
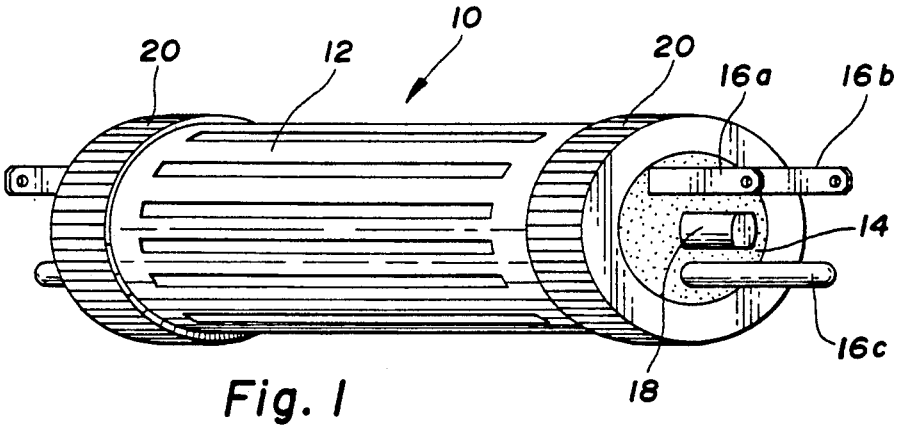
FIG. 1 is a perspective view of an electrical connector device embodying the present invention.

The electrical connector device of the present invention is shown generally at 10 in FIG. 1. The device 10 includes a body 12 which preferably has an elongated, cylindrical shape. Each end of the body 12 is fitted with threaded end caps 20. Each end cap retains a terminal set insert 14 formed of a non-conductive material, such as Bakelite.

Each insert 14 is fitted with a terminal set 16(*a*), (*b*) and (*c*). The terminal set at the opposite (or left) end of the device 10 shown in FIG. 1 is like the exposed end being described presently.

The terminals 16(*a*) and (*b*) are conventional blade or spade-type terminals, and may be polarized in conventional manner. The terminal 16(*c*) is a ground terminal.

The terminal set insert 14 is formed with a central opening which receives and permits reciprocal movement of a plunger 18, whose operation will be described presently in connection with FIGS. 3 and 4.

Figure 3:
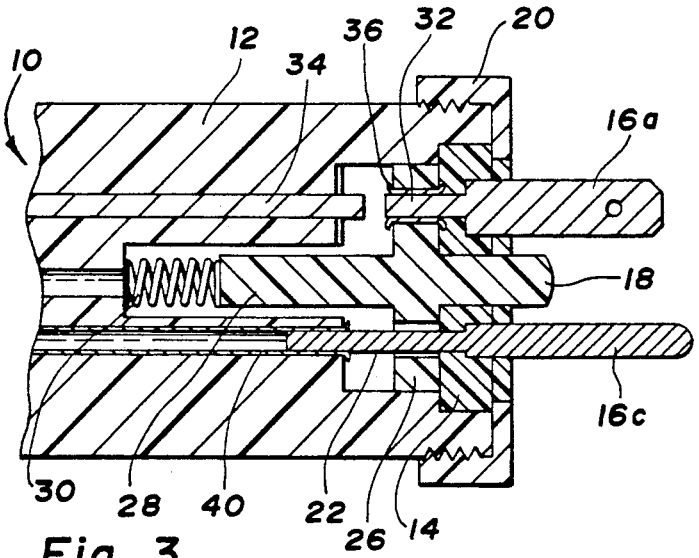
FIG. 3 is a cross-sectional view of the connector device taken along line 3—3 of FIG. 2 showing the device in a first operating state.
Figure 2:
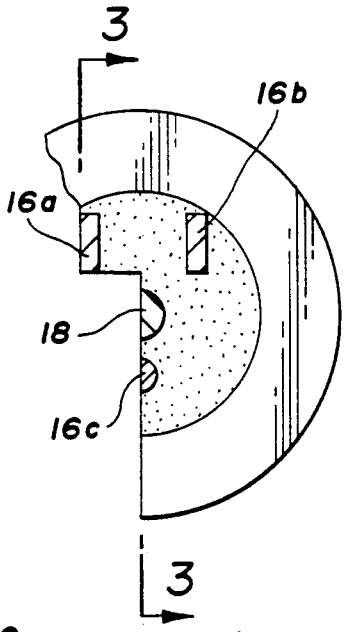
FIG. 2 is a fragmentary end view of the connector device of FIG. 1.
Figure 4:
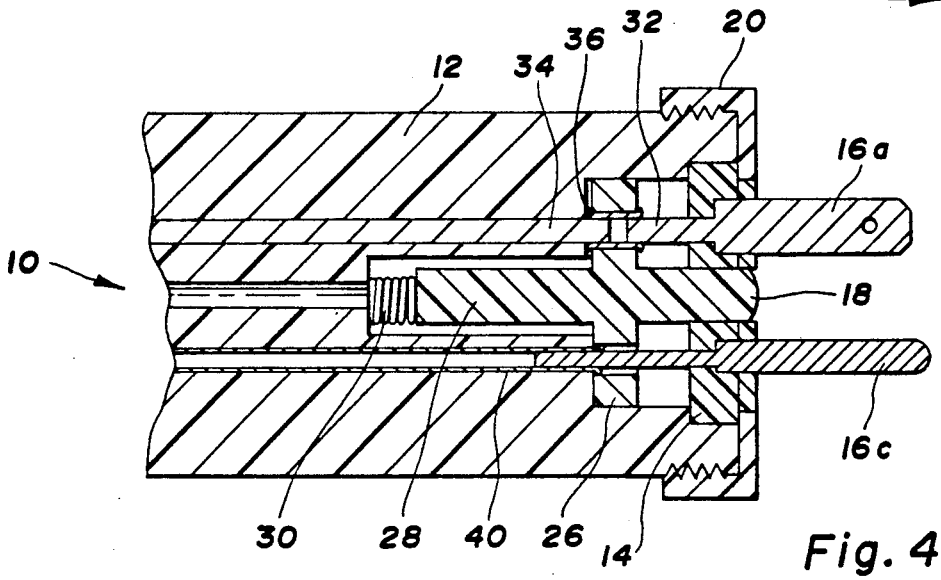
FIG. 4 is a cross-sectional view similar to FIG. 3, but showing the electrical connector device in its other operating state.

FIGS. 3 and 4 serve to illustrate the operating states of the electrical connector device when the terminal set is decoupled and coupled, respectively, to a matched electrical connector. These figures are derived from the cutting plane line 3—3 taken through the fragmentary end view of FIG. 2.

The electrical connector device 10 is shown in its decoupled operating state in FIG. 3. The end cap 20 is shown threaded onto the body 12. The end cap 20 retains the terminal set insert 14 in a substantially concentric position. In this embodiment blade terminals 16*a* and 16*b* (not shown) are molded in place in the insert 14. The blade 16*a* and 16*b* have internal terminals 32. The ground terminal 16*c* has a continuous internal terminal 22.

The plunger 18 includes a tip which projects through the center opening of the insert 14 as shown in FIG. 3. Internal of the plunger tip is a set of apertures which receive the internal terminals 32 (for blade terminals 16*a* and 16*b* and 22 (for ground terminal 16*c*). The plunger includes an internal extension 28 which contacts a compression spring 30 seated in a central recess within the body 12.

The apertures in the terminal set insert which receive the internal terminals 32 are fitted with conductive sleeves 36, which, as described in reference to FIG. 4, serve to assist in "making" and "breaking" electrical contact. In aligned relation to the internal terminal 32 is an internal conductive rod 34 which extend through the length of the connector body 12. Each of the blade terminals 32 has a counter-poised conductor rod 34.

The internal segment 22 of the ground terminal 16*c* is received within a conductive sleeve 40 which extends through the length of the conductor body 12. The electrical contact between the internal segment 22 and the sleeve 40 is constant in both operating states of the connector device.

In FIG. 4 the electrical connector device 10 is shown as it would appear when coupled with a matched electrical connector. More particularly, the plunger 18 is depressed flush with the surface of the end cap 20. The depression of the plunger 18 acts against the restorative force of the compression spring 30. Also, the displacement of the plunger causes the conductive sleeve 36 to make electrical contact between terminal segment 32 and conductive rod 34. The depression of the plunger 18 thus ends the electrical isolation of the terminal set at the one end face of the electrical connector device 10. If the other terminal set at the opposite connector face is similarly coupled to a matched electrical connector, the device 10 will serve to interconnect the device to which its terminal sets are coupled. One example of such interconnection is between the receptacles of a household circuit and the power takeoff of an auxiliary generator. The electrical interlock function obtained by reciprocal movement of the plunger in the device protects against exposure of energized terminals, and reduces or eliminates the risk of electrical shock or shorting of circuits.

FIGS. 5 through 12 illustrate in greater detail the component members of the electrical connector device of the present invention.

FIGS. 5 and 6 show the connector body 12 in detail view. The body 12 includes threaded ends 42 and an optional central aperture 44 to prevent entrapment of moisture.

FIGS. 7 and 8 show the end cap 20 in elevation and end views.

FIGS. 9 and 10 show the terminal set insert 14 in elevation and end views. The terminal set insert preferably comprises a body molded of nonconductive plastic having embeded therein the blade terminals 16*a* and *b* with internal segments 32 (and the ground terminal 16*c* (with internal segment 22). The body of the insert 14 has a central opening 24 to receive the plunger.

FIGS. 11 and 12 are elevation and end views of the plunger 18. The plunger also includes a body segment 26 which is formed with apertures to receive the internal terminal segments 32 and 22. The apertures which receive the internal segments 32 are fitted with conductive sleeves 36.

The invention has been described in an illustrative embodiment with male terminal sets on the opposed faces for interconnecting matched female electrical devices. However, the interlock device of the present invention may be utilized independent of the specific embodiment shown without departing from the scope of the invention.

The embodiments of the invention in which an exclusive property or privilege is claimed are defined as follows:

1. An electrical connector device comprising:

a body having first and second connector faces;

first and second male terminal sets associated with each connector face, each terminal set including a plurality of at least two terminals adapted to couple to a matched female electrical connector;

a like plurality of electrical conductors extending internally of the body between the connector faces for providing conductive paths between corresponding terminals of the first and second terminal sets; and, switch means associated with each of the connector faces and responsive to coupling of a terminal set with a matched electrical connector, for electrically connecting at least one of the terminals of the set with an internal electrical conductor.

2. The electrical connector device of claim 1 wherein the switch means comprises a plunger, reciprocable between retracted and extended positions relative to the connector face, for connecting and disconnecting, respectively, at least one of the terminals of the set in response to coupling and decoupling of such terminal set to a matched connector.

3. The electrical connector device of claim 2 wherein the plunger is biased to its extended position to normally disconnect said at least one terminal.

4. An electrical connector device comprising a body having a pair of male terminals adapted to couple to a matched female connector, and switch means, associated with at least one of the male terminals and responsive to engagement and disengagement of the terminals with the female connector, for connecting and isolating, respectively, the associated terminal, said switch means comprising a plunger member which is displaced upon engagement and disengagement with a matched female connector to connect and disconnect, respectively, the associated terminal through direct displacement of a conductive sleeve which brings the terminal into contact with a conductive member upon engagement, and out of contact upon disengagement.

5. The connector device of claim 4 wherein the plunger is reciprocable between a retracted position within the body when engaged, and an extended position exteriorly of the body when disengaged.

6. The connector device of claim 4 wherein the plunger is biased toward a position corresponding to disengagement of the connector.

* * * * *